US007112150B2

(12) United States Patent
Dionne

(10) Patent No.: US 7,112,150 B2
(45) Date of Patent: Sep. 26, 2006

(54) METHOD FOR CHIPPING AND CLUB

(76) Inventor: Patrice Dionne, 100 Avery St., Chapel Hill, NC (US) 27514

( * ) Notice: Subject to any disclaimer, the term of this patent is extended or adjusted under 35 U.S.C. 154(b) by 1183 days.

(21) Appl. No.: 09/349,306

(22) Filed: Jul. 8, 1999

(65) Prior Publication Data

US 2001/0002371 A1 May 31, 2001

(51) Int. Cl.
*A63B 53/00* (2006.01)

(52) U.S. Cl. ..... 473/409; 473/293

(58) Field of Classification Search ..... 473/294, 473/293, 290, 409, 252
See application file for complete search history.

(56) References Cited

U.S. PATENT DOCUMENTS 4,426,083 A * 1/1984 Dishner, Jr. ..... 473/252
5,690,556 A * 11/1997 Condon ..... 473/252
5,830,082 A * 11/1998 White ..... 473/294
5,855,524 A * 1/1999 Jenkins ..... 473/284
5,890,971 A * 4/1999 Shiraishi ..... 473/291
5,976,025 A * 11/1999 Williams ..... 473/252
6,039,657 A * 3/2000 Gidney ..... 473/252
6,068,562 A * 5/2000 Hedges ..... 473/409

* cited by examiner

*Primary Examiner*—Raleigh W. Chiu
(74) *Attorney, Agent, or Firm*—Smith & Hopen, P.A.

(57) ABSTRACT

A method for making chips shots with a novel golf club having a club head positioned at a one hundred degree angle to an elongate club shaft. The golfer stands beside a golf ball while facing a target hole so that the ball is close to an exterior side of the golfer's dominant foot. The golfer's dominant arm is held straight by his or her side and the golfer's dominant hand grasps the elongate shaft. The golfer's other arm reaches across the golfer's chest and grasps the elongate shaft near its upper end. A back swing, forward swing, and follow through are then made in a motion much like the motion made when tossing a hand-held golf ball toward a target hole with an underarm throw.

2 Claims, 2 Drawing Sheets

METHOD FOR CHIPPING AND CLUB

BACKGROUND OF THE INVENTION

1. Field of the Invention

This invention relates, generally, to methods for playing the game of golf. More particularly, it relates to a method for chipping around the green. It also relates to a club having utility in performing the steps of the method.

2. Description of the Prior Art

A chip shot differs from a putt in that a chip shot causes a golf ball to leave the ground when the ball is struck. After an initial flight through the air, the ball then falls to the ground and rolls.

Most beginning golfers have a difficult time learning how much strength they should put into a chip shot. Golf instructors commonly instruct their students to use as much strength as they would use if simply holding a golf ball in their throwing hand and then tossing the ball with an underarm throw toward the hole from a standing position facing the hole.

This well-known instructional technique has value because it demonstrates the ball flight and speed required for a good chip shot. Some of the value is lost, however, when an actual chip shot is made because the golfer must stand at a right angle to the target hole and must strike the ball with a golf club.

It is very difficult to translate into a chip shot the strength used in tossing a hand-held ball toward a hole while facing the hole. In part, this is true because more muscles are involved when addressing a golf ball with a club in the conventional way than when simply making an underarm toss. Moreover, making a conventional golf chip shot requires a somewhat unnatural use of muscles.

What is needed, then, is an improved method for teaching golfers how much strength to use when hitting chip shots.

A golf club that enables execution of the new method is also required.

However, in view of the art considered as a whole at the time the present invention was made, it was not obvious to those of ordinary skill in this art how the needed improvements could be provided.

SUMMARY OF THE INVENTION

The long-standing but heretofore unfulfilled need for an apparatus that overcomes the limitations of the prior art is now met by a new, useful, and nonobvious invention. The steps of the novel method include selecting a golf club having an elongate shaft, having a club head that is disposed at a substantially one hundred degree angle relative to said elongate shaft, and having a lofted club face.

The golf club is maintained in a substantially vertical plane by first and second hands of a golfer standing in an erect posture and facing a target golf hole, and a golf ball is positioned near a preselected foot of the golfer on an exterior side thereof.

The elongate shaft is adapted to be grasped, generally mid-length thereof, from behind by a hand of a substantially straight first arm of the golfer.

An upper end of the elongate shaft is adapted to be grasped by a second hand of the golfer having a second arm bent at the elbow and extending across the chest in grasping relation to the upper end in the general vicinity of the shoulder.

The club head is swung away from the target hole by a distance substantially equal to the distance of a back swing when tossing a hand-held golf ball toward a target hole with an underarm toss while facing the target hole.

A forward swing of the golf club is performed by swinging the club head toward the target hole with a force substantially equal to a force used when tossing a hand-held golf ball toward a target hole with an underarm toss while facing the target hole.

The club head of the golf club therefore passes the exterior side of the foot in closely spaced relation thereto.

In this way, a chip shot is executed by a golfer while standing erect and facing a target golf hole and while swinging the club head with a motion and with a force substantially equal to a motion and force used to perform an underarm toss of a golf ball toward a target golf hole.

It is a primary object of this invention to provide a new method for teaching golfers how hard they should strike a golf ball when making chip shots.

Another object is to provide a specially designed golf club that enables the new method to be performed.

These and other important objects, features, and advantages of the invention will become apparent as this description proceeds.

The invention accordingly comprises the features of construction, combination of elements, arrangement of parts, and method steps that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
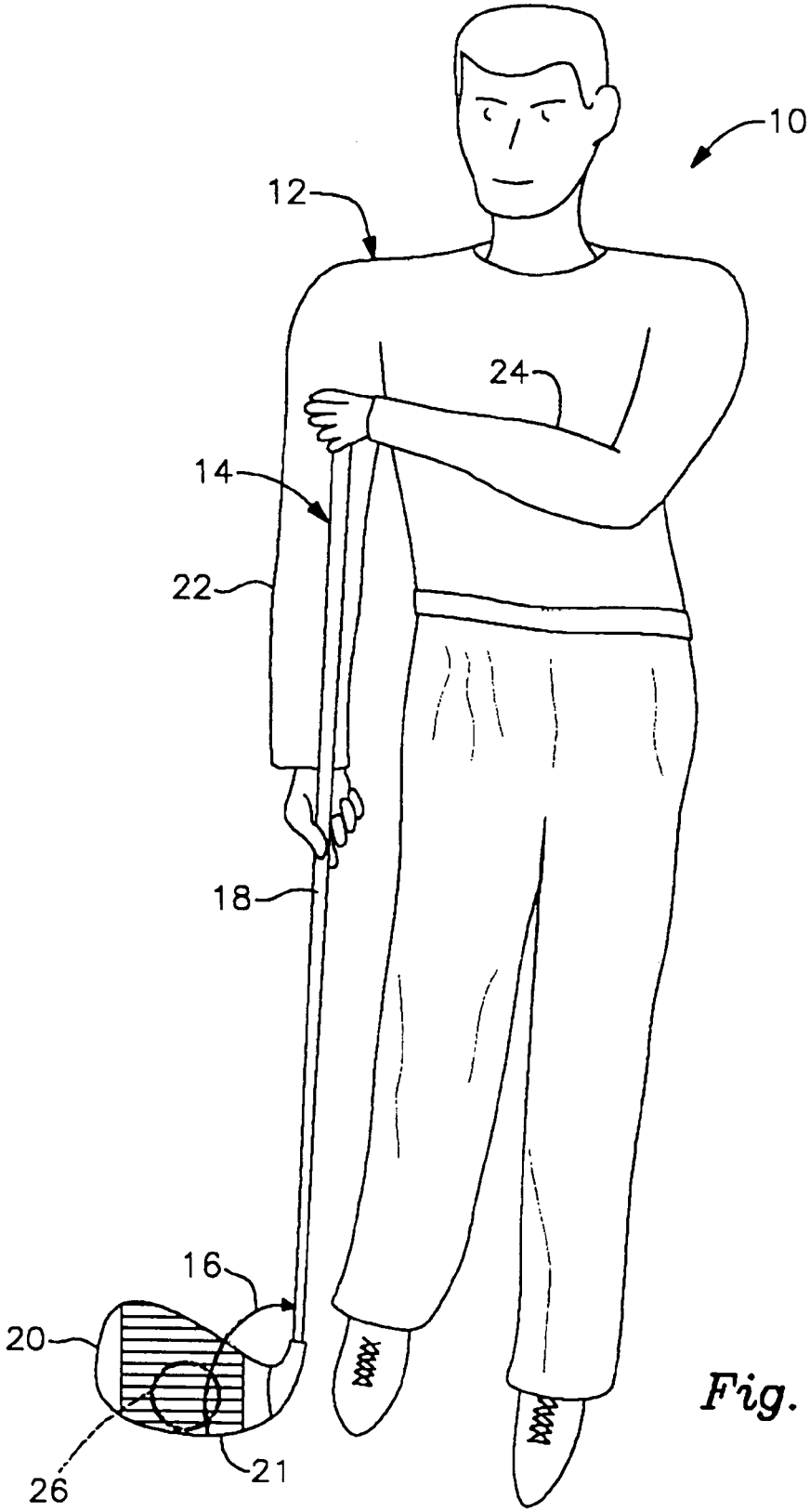
FIG. 1 is a front elevational view of a golfer holding the novel golf club while preparing to follow the steps of the novel method.

Referring now to FIG. 1, it will there be seen that an exemplary embodiment of the invention is denoted as a whole by the reference numeral 10.

A right-handed golfer 12 is depicted facing a golf hole, not shown. Note that golfer 12 is standing erect, i.e., said golfer does not bend over at the waist, nor does said golfer bend his or her knees. Note further that the golfer's head is not bent downwardly to look at the ball and that the golfer does not lean to either side. At all relevant times, the golfer looks at the target golf hole, just as he or she would do when making an underarm toss of a golf ball toward a target hole.

The novel golf club is denoted 14 as a whole and has a length of approximately four feet or so. As indicated in FIG. 1, this length is sufficient to enable a golfer to hold the novel club in the manner hereinafter described while standing erect.

Significantly, angle 16 between the longitudinal axis of elongate shaft 18 of the golf club and the sole 21 of club head 20 is preferably about one hundred degrees so that sole 21 is substantially parallel to the ground at the moment of impact of the club head against the ball.

Figure 2:
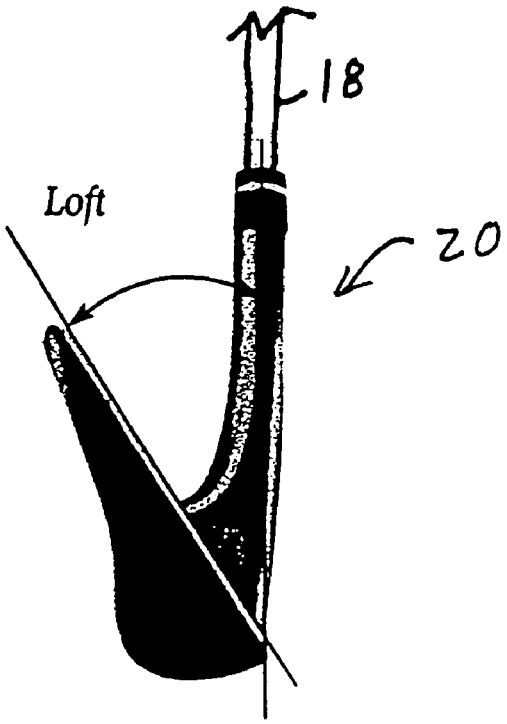
FIG. 2 is a side elevational view of the novel club head.

As indicated in FIG. 2, club head 20 is lofted. The preferred amount of loft is substantially equal to that of an eight iron, about thirty eight degrees, but other loft angles are within the scope of this invention.

Note that the golfer's right arm 22 is positioned behind shaft 18 in registration therewith. The right elbow of the golfer is preferably not bent although a small amount of bending should not present a major problem.

Note further that when the golfer's right arm is positioned as depicted in FIG. 1, elongate shaft 18 of club 14 is grasped about mid-length thereof, from behind, relative to the target hole, by the golfer's right hand.

Note further that the golfer's left arm 24 is bent about ninety degrees at the elbow and that the left forearm is held across the chest in substantially parallel relation to the ground. The left hand grips elongate shaft 18 near or at its uppermost end as depicted.

The golfer positions the exterior side of his or her right foot by ball 26 such that said ball is substantially in line with the ankle of the foot. However, ball 26 may be placed a little closer to or further away from the hole, depending upon the golfer's preference.

Elongate shaft 18 is adapted to be positioned in a substantially vertical plane, i.e., it is adapted to be held in substantially perpendicular relation to the ground. This positions club head 20 very near to the golfer's foot as depicted and positions sole 21 of club head 20 parallel to the ground as mentioned earlier. However, since angle 16 between shaft 18 and club head 20 is one hundred degrees (100°), the golfer need not lean over sideways to hold shaft 18 perpendicular to a putting surface. Instead, when the golfer is standing fully erect, facing a target hole, shaft 18 is positioned at a ten degree (10°) angle relative to an imaginary line extending in perpendicular relation to the putting surface. This ten degree (10°) angle is denoted 17 in FIG. 1. If angle 16 were only ninety degrees (90°), the golfer would be required to lean over to the side to hold shaft 18 perpendicular to said putting surface. Such leaning would make it much more difficult to aim and swing the club in the manner required to simulate an underarm toss. Thus it is understood that the method step of providing a one hundred degree (100°) angle between shaft 18 and club head 20 is a critical step of the invention. Moreover, it should be noted that shaft 18 and club head 20 lie in a plane that is perpendicular to an imaginary line drawn from the target hole to the golf ball. The one hundred degree (100°) angle is measured in said plane.

However, since angle 16 between shaft 18 and club head 20 is one hundred degrees (100°), the golfer need not lean over sideways to hold shaft 18 perpendicular to a putting surface. Instead, when the golfer is standing fully erect, facing a target hole, shaft 18 is positioned. at a ten degree (10°) angle relative to an imaginary line extending in perpendicular relation to the putting surface. This ten degree (10°) angle is denoted 17 in FIG. 1. If angle 16 were only ninety degrees (90°), the golfer would be required to lean over to the side to. hold shaft 18 perpendicular to said putting surface. Such leaning would make it much more difficult to aim and swing the club in the manner required to simulate an underarm toss. Thus it is understood that the method step of providing a one hundred degree (100°) angle between shaft 18 and club head 20 is a critical step of the invention.

To execute a chip shot, the golfer swings club head 20 back, i.e., away from the target hole by about the same distance as he or she would swing his or her right arm back when tossing a hand-held golf ball toward the hole. The back swing is followed immediately by a forward swing that exerts about the same amount of strength that would be exerted if tossing a hand-held golf ball toward the target hole with an underarm pitch. The forward swing brings club head 20 very close to the golfer's right foot at the moment the ball is struck, and a follow-through movement, substantially equal in extent to the length of the back swing, continues after the moment of impact, just as a follow-through is performed after a hand-held ball has been released when making an underarm toss.

This natural-feeling movement cannot be satisfactorily performed with a conventional golf club. Angle 16 in a conventional club is substantially more than one hundred degrees. Thus, if the novel method is practiced with a conventional club, the golfer will have to stand a foot or more away from the ball so that the sole of the club head may be parallel to the ground. This would distort the underarm motion required because it is not natural to perform an underarm toss with the throwing hand held a foot or more from the body.

As indicated in FIG. 1, the golfer may place the foot next to the golf ball a little behind the other foot, since this is the natural stance one assumes when tossing a hand-held ball with an underarm motion.

All positions depicted and described herein are reversed for left-handed golfers.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method of swinging a golf club, comprising the steps of:

standing in a fully erect posture and facing a target golf hole;

providing a golf club having an elongate shaft of predetermined elongate extent;

positioning a club head of said golf club and said elongate shaft of said golf club in a substantially vertical plane, said vertical plane being substantially perpendicular to the ground and being perpendicular to an imaginary line drawn from said target hole to a golf ball;

said predetermined elongate extent being sufficient to adapt said golf club to be maintained in said substantially vertical plane by first and second hands of a golfer standing in said fully erect posture and facing said target golf hole;

positioning a golf ball near a preselected foot of said golfer on an exterior side thereof;

said elongate shaft adapted to be grasped, generally mid-length thereof, from behind by a hand of a substantially straight first and of said golfer;

an upper end of said elongate shalt adapted to be grasped by a second hand of said golfer having a second arm bent at the elbow and extending across the chest in grasping relation to said upper end in the general vicinity of the shoulder;

swinging the club head away from the target hole by a distance substantially equal to the distance of a back swing when tossing a band-held golf ball toward said target hole with an underarm toss while facing said target hole;

said substantially straight first arm of said golfer being disposed in laterally spaced relation away from the body of said golfer so that said back swing performed by said golfer is unimpeded by said golfer's body;

swinging the golf club and hitting the golf ball by swinging the club head toward the target hole with a force substantially equal to a farce used when tossing a hand-held golf ball toward said target hole wit an underarm toss while facing said target hole;

performing said steps with a golf club bead disposed at a substantially one hundred degree angle relative to said elongate shaft so that a sole of said club head is substantially parallel to the ground at the moment of impact of the club head against the ball and so that said shaft is positioned at an angle of about ten degrees relative to an imaginary line that is perpendicular to a putting surface;

whereby the club head of said golf club passes said preselected foot in closely spaced relation thereto; and whereby a chip shot is executed by a golfer while standing fully erect and facing a target hole and while swinging the club head with a motion and with a force substantially equal to a motion and force used to perform an underarm toss of a golf ball toward a target hole.

2. The method of claim 1, further comprising the step of performing all of the steps of claim 1 with a lofted club head.

* * * * *